US005819914A

United States Patent [19]

Yoneyama

[11] Patent Number: 5,819,914

[45] **Date of Patent: *Oct. 13, 1998**

[54] PUSHBUTTON SWITCH

[75] Inventor: Masayuki Yoneyama, Tokyo, Japan

[73] Assignee: Minebea Co., Ltd., Kitasaku, Japan

[ * ] Notice: The term of this patent shall not extend beyond the expiration date of Pat. No. 5,597,067.

[21] Appl. No.: 751,246

[22] Filed: Nov. 18, 1996

Related U.S. Application Data

[62] Division of Ser. No. 333,983, Nov. 2, 1994, Pat. No. 5,597,067.

[30] Foreign Application Priority Data

Aug. 3, 1994 [JP] Japan ..... 6-201341

[51] Int. Cl.[6] ..... H01H 13/70

[52] U.S. Cl. ..... 200/344; 200/341

[58] Field of Search ..... 200/341, 344, 200/345, 512, 517, 520

[56] References Cited

U.S. PATENT DOCUMENTS

| | | |
|---|---|---|
| 4,433,225 | 2/1984 | Cowles . |
| 4,902,862 | 2/1990 | Oelsch et al. . |
| 5,203,448 | 4/1993 | Osada et al. . |
| 5,268,545 | 12/1993 | Bruner . |
| 5,278,371 | 1/1994 | Watanabe et al. . |
| 5,278,372 | 1/1994 | Takagi et al. . |
| 5,278,374 | 1/1994 | Takagi et al. . |
| 5,280,147 | 1/1994 | Mochizuki et al. . |
| 5,399,822 | 3/1995 | Sato et al. . |
| 5,424,516 | 6/1995 | Emmons . |

FOREIGN PATENT DOCUMENTS

| | | |
|---|---|---|
| 0 499449 | 8/1992 | European Pat. Off. . |
| 0 564 230 | 6/1993 | European Pat. Off. . |
| 37 19839 | 10/1988 | Germany . |

OTHER PUBLICATIONS

U.S. Patent No. 4,902,862 is the English language equivalent of German Patent No. 37–19839.

U.S. application No. 08/333,983, Masayuki Yoneyama, filed Nov. 2, 1994, Minebea Co., Ltd.

*Primary Examiner*—David J. Walczak

*Attorney, Agent, or Firm*—Staas & Halsey

[57] ABSTRACT

A pushbutton switch opens and closes a contact circuit through resilient depression of an elastic material which is actuated through a key cap. A membrane sheet carries the contact circuit and a keyboard frame guide is disposed thereabout. A stem and rubber spring are disposed within the keyboard frame guide and move in response to depression of the key cap to thereby actuate the contact circuit. A stabilizer is attached to the stem and a keyboard frame for providing stability to the stem. The stem includes an opening therein through which a portion of the stabilizer assembly is slidably received. The stabilizer assembly includes a pair of intersecting arms forming an X shape. Orthogonal actuator rods connect each pair of arms and are received within the opening of the stem. The rubber spring is disposed between the stem and the contact circuit and urges the stem upward to release contact with the contact circuit. The pushbutton switch may join an assembly of similar pushbutton switches in an arrangement such as a keyboard.

7 Claims, 4 Drawing Sheets

PUSHBUTTON SWITCH

This application is a division of application Ser. No. 08/333,983, filed Nov. 2, 1994, now U.S. Pat. No. 5,597,067.

BACKGROUND OF THE INVENTION

1. Field of the Invention

The present invention relates to a pushbutton switch and more particularly, to a pushbutton switch construction for use in a keyboard.

2. Description of the Prior Art

A keyboard as a data entry device for use with a microcomputer generally has a plurality of pushbutton switches arranged on the front panel thereof. The pushbutton switches are arranged on a membrane sheet which comprises an array of contact circuits allocated by a known printed circuit technique and disposed together with a spacer between two synthetic resin layers sheets so that when the two layers are depressed against each other, a corresponding number of the contact circuits are closed. For each pushbutton switch, an elastic material such as a rubber spring having an inverted bowl shape is placed on the contact circuit of the membrane sheet. When the rubber spring is pressed down by the click action of a key, the circuit closes.

However, the elastic material of such a conventional pushbutton switch has a relatively long stroke for switching action. This results in an increase of the height of the pushbutton switch. For eliminating the above drawback, a modified pushbutton switch has been disclosed in Japanese Patent Laid-open Publication 4-2484432 (1992) or U.S. Pat. No. 5,203,448 where an intermediate element is disposed between the contact region of a key and the substrate on a membrane sheet so that it can slide along the key contact region and the substrate. In action, when the key is depressed, its contact region comes into direct contact with and lowers the intermediate element. The switching stroke of the key is equal to a sum of the clearance between the key and the intermediate element and the clearance between the intermediate element and the substrate. Accordingly, even if the switching stroke of the elastic material is set identical to that of the conventional pushbutton switch, the overall height of the modified pushbutton switch, i.e. from the membrane sheet to the top of the key, can be decreased.

The modified pushbutton switch has the intermediate element mounted between the substrate of the membrane sheet and the contact region of the key so that it can slide along both the substrate and the key contact region and will thus be decreased in overall height. The disadvantage of the modified pushbutton switch is that dimensional error on the sliding element is as large as two times that of the conventional switch because two sliding actions are involved between the key and the intermediate element and between the intermediate element and the substrate. This will cause the vertical movement of the key to wobble more or less and to attenuate the stability. Also, the key is supported by the intermediate element which is not anchored to the substrate or stationary base, thus failing to contribute to the structural strength of the pushbutton switch.

The present invention is directed towards eliminating the above disadvantages and its object is to provide an improved pushbutton switch for opening and closing a contact circuit by way of the resiliency of an elastic material actuated through an intermediate element by a key, in which the switching action of the key is made stable and ensured by the physical strength of an inventive arrangement including the intermediate element and the elastic material on a membrane sheet.

SUMMARY OF THE INVENTION

For elimination of the foregoing disadvantage of the prior art pushbutton switch, the present invention provides an improved pushbutton switch.

The pushbutton switch of the present invention for opening and closing a contact circuit by means of the resiliency of an elastic material actuated through an intermediate element by a key cap, comprises: a membrane sheet carrying the circuit contacts; a keyboard frame guide disposed on a substrate; a stem having an opening therein where an external actuating force is applied to move the stem along the keyboard frame guide; a rubber spring disposed between the stem and the membrane sheet for making the circuit when being pressed down by the stem and lifting up the stem to its original position when the stem is released from a pressure; and a stabilizer assembly mounted at one end to the substrate for pivotal movement and formed of an X shape in cross section by intersecting at least two arms at center to each other, each arm having an actuator rod mounted to a central region thereof and accommodated in the opening of the stem for sliding movements The upper ends of the arms of the stabilizer assembly are supported by the back side of the key cap for pivotal movement.

The operation of the above pushbutton switch will now be explained.

When the key cap is pressed down, the stabilizer assembly starts being compressed. As the upper end of the stabilizer assembly is pivoted on the key cap, the key cap moves straight down without wobbling while being guided by the keyboard frame guide. Simultaneously, the two actuator rods of the stabilizer assembly travel in opposite directions along the opening of the stem and the pivot axles of the same slide outwardly along the support slits. Accordingly, the downward movement of the stem presses down the rubber spring to bottom. When the stem reaches its lowest position, the rubber spring is flattened with its pressing projection acting on a corresponding switch region of the membrane sheet for switching on. When the key cap is released, the rubber spring returns back by its resiliency to lift up the stem. As in a reverse movement, the stabilizer assembly expands and the key cap is returned back to its original height.

DESCRIPTION OF THE PREFERRED EMBODIMENTS

Figure 1:
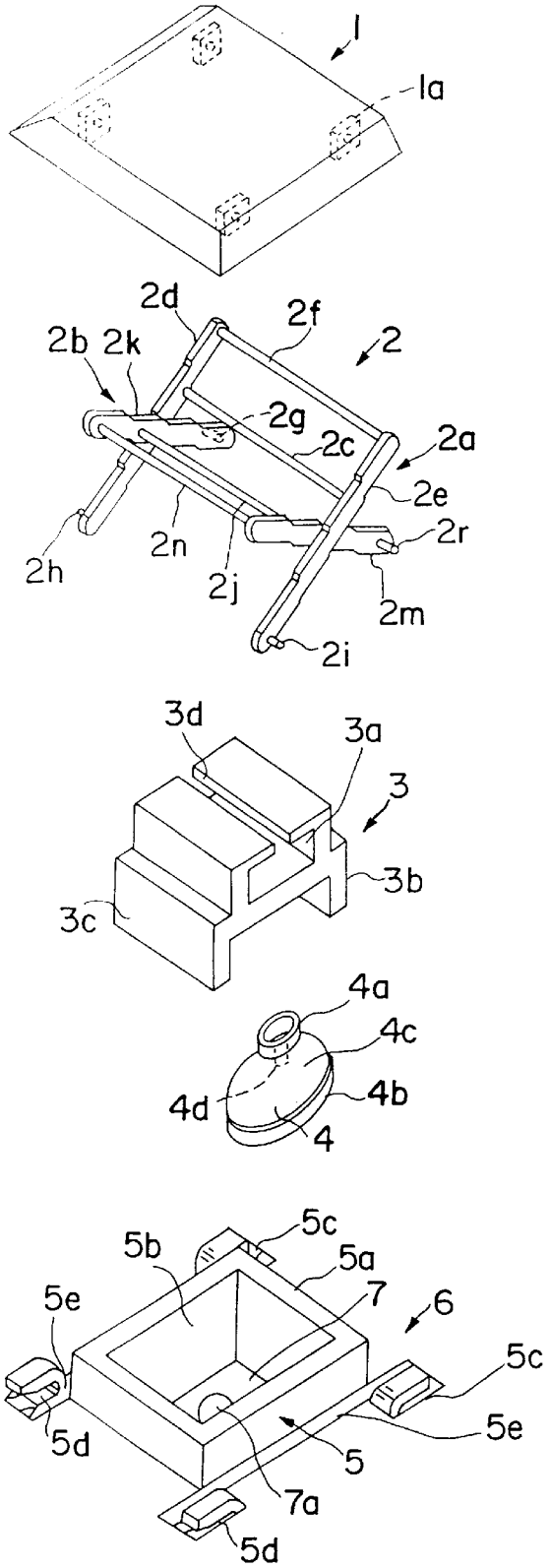
FIG. 1 is an exploded perspective view showing one embodiment of the present invention.

Preferred embodiments of the present invention will be described referring to the accompanying drawings. FIG. 1 is an exploded perspective view of a pushbutton switch according to the present invention. As shown, a key cap 1 having in common a character or numeral printed on the upper surface thereof is provided for switching action by the operator. The key cap 1 has four pivot supports 1*a* provided on the back surface thereof for pivotably supporting a stabilizer assembly as will be explained later. The stabilizer assembly 2 comprises two actuator frames 2*a* and 2*b* of ladder shape which are joined to each other to form an X shape in cross section. More particularly, the actuator frame 2*a* comprises two arms 2*d* and 2*e* joined approximately at a center thereof by an actuator rod 2*c* to each other. Actuator frame 2*b* also comprises three pivot axles 2*f*, 2*h*, and 2*i* mounted to both ends of the arms 2*d* and 2*e*. Similarly, the actuator frame 2*b* comprises two arms 2*k* and 2*m* joined approximately at a center therof by an actuator rod 2*j* to each other. Actuator frame 2*b* also comprises three pivot axles 2*n*, 2*c*, and 2*r* mounted to both ends of the arms 2*k* and 2*m*. The actuator frame 2*a* is wider in distance between the two arms 2*d* and 2*e* than the two arms 2*k* and 2*m* of actuator frame 2*b*.

A stem 3 is provided for transmitting the pressing force applied to the key cap 1 through the two actuator rods 2*c* and 2*j* of the stabilizer assembly 2 to a membrane switch, which will be explained later in more detail. The stem 3 has a center opening 3*a*, provided in the center thereof for movably accommodating the two actuator rods 2*c* and 2*j* of the stabilizer assembly 2. The stem 3 also has two guide arms 3*b* and 3*c* extending downwardly from both sides thereof. The stem 3 has a slot 3*d* provided on the top thereof for passing the two actuator rods 2*c* and 2*j* to the center opening 3*a* during assembly.

There is also provided a rubber spring 4 made of a highly elastic synthetic resin or rubber material of substantially an inverted bowl shape. More specifically, the rubber spring 4 comprises a pressing head 4*a* having such a thickness such that no deformation occurs, a ring foot 4*b* for installation on the membrane switch, and a thin spring body 4*c* between the head 4*a* and the foot 4*b* for producing a spring effect. Also, a downward projection 4*d* is provided beneath the pressing head 4*a* of the rubber spring 4 for directly actuating the membrane switch.

A keyboard frame guide 5 is arranged integrally with a keyboard frame (substrate) 6, thus designating an upper part of the membrane switch. More particularly, the keyboard frame guide 5 comprises a four-sided vertical wall 5*a* extending upwardly from the keyboard frame 6 and defining a center opening 5*b* at the inside which allows a switch region 7*a* of a membrane sheet 7 to be exposed. Also, two pairs of support slits 5*c* and 5*d* are provided outside the wall 5*a* for accommodating the pivot axles 2*g* and 2*r* of the actuator frame 2*b* and the pivot axles 2*h* and 2*i* of the actuator frame 2*a* respectively. Two long recesses 5*e* are provided in the keyboard frame 6 for accepting the arms 2*d* and 2*e* of the stabilizer assembly 2 on both sides of the four-sided wall 5*a*.

A procedure of assembling the foregoing components of the pushbutton switch will now be described. First, the rubber spring 4 is placed in the opening 5*b* of the keyboard frame guide 5 with its ring foot 4*b* directly seated over the switch region 7*a* of the membrane sheet 7. The keyboard frame guide 5 is then covered from above with the stem 3 so that its opening 5*b* accepts the guide arms 3*b* and 3*c* of the stem 3 which are thus sustained by two opposite sides of the four-sided wall 5*a* respectively. The actuator rods 2*c* and 2*j* of the stabilizer assembly 2 are fitted through the slit 3*d* into the opening 3*a* of the stem 3 while the pivot axles 2*g* and 2*r* of the actuator frame 2*b* are accepted in the support slits 5*c* and the pivot axles 2*h* and 2*i* of the actuator frame 2*a* are accepted in the support slits 5*d*. Finally, the key cap 1 is coupled to the stabilizer assembly 2 by fitting the pivot axles 2*f* and 2*n* of their respective actuator frames 2*a* and 2*b* into the pivot supports 1*a*.

Figure 2:
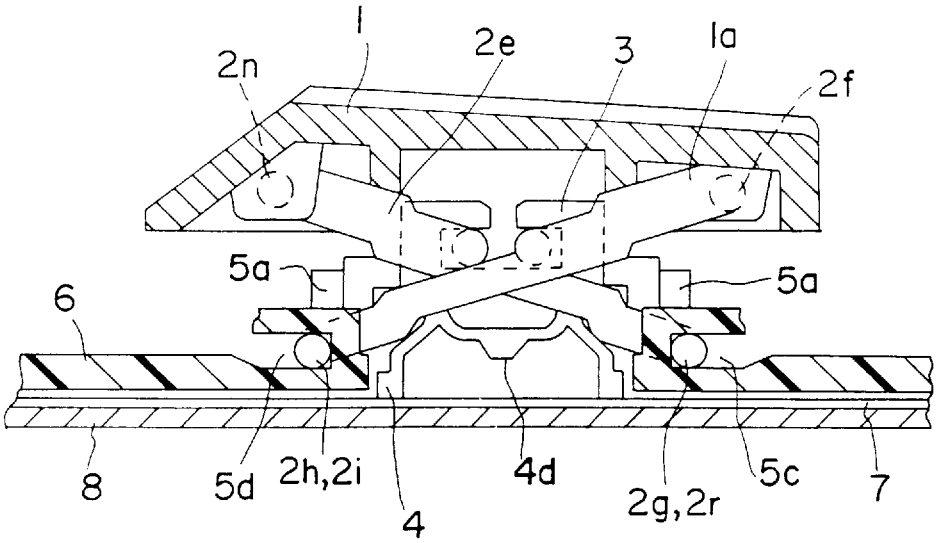
FIG. 2 is a cross sectional view of the same.
Figure 3:
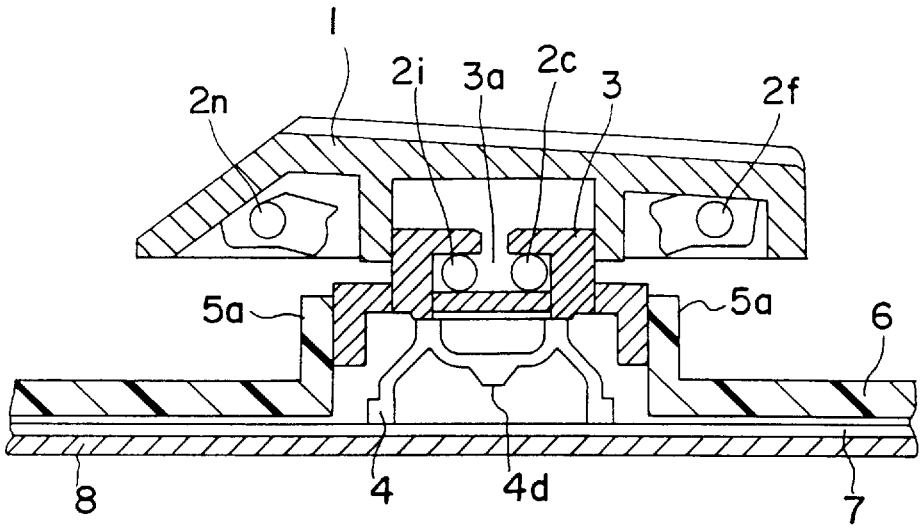
FIG. 3 is a cross sectional view of the same without a stabilizer assembly.

FIG. 2 is a cross sectional view of the pushbutton switch after completion of the assembly procedure. As shown, a back plate 8 is mounted to the back surface of the membrane sheet 7. FIG. 2 illustrates no pressure on the rubber spring 4. More specifically, the rubber spring 4 supports the stem 3 from below, as best shown in FIG. 3. In this state, the stabilizer assembly 2 is held with its pivot axles 2*g*, 2*r* and 2*h*, 2*i* in the deepest locations of the support slits 5*c* and 5*d*, thus restricting upward movement of the stem 3.

When the key cap 1 is pressed downwardly, the stabilizer assembly 2 is compressed. More particularly, as the arms 2*d* and 2*e* of the stabilizer assembly 2 move about the pivot supports 1*a* of the key cap 1, the key cap 1 can be lifted down vertically as guided with the stem 3 moving along the keyboard frame guide 5. Also, the actuator rods 2*c* and 2*j* of the stabilizer assembly 2 in the opening 3*a* of the stem 3 presses down the stem 3 as they move horizontally in opposite directions. Simultaneously, the pivot axles 2*g* and 2*r* of the stabilizer assembly 2 slide outwardly in their respective support slits 5*c* while the pivot axles 2*h* and 2*i* slide outwardly in their respective support slits 5*d*.

Figure 4:
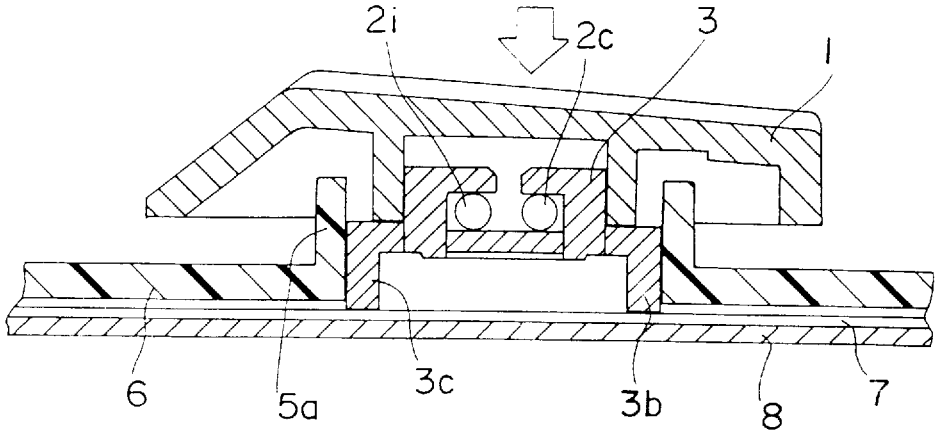
FIG. 4 is a cross sectional view of the same explaining a switching action.
Figure 5:
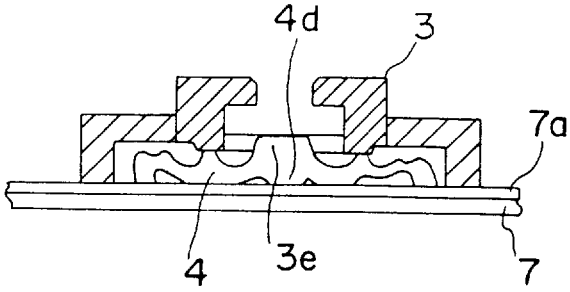
FIG. 5 is a cross sectional view of a part of the same illustrating the action of a rubber spring.

The stem 3 moves downward and presses against the rubber spring 4 for distortion, as shown in FIG. 5. Aperture 3*e*, provided in the bottom deck of stem 3 accepts a part of rubber spring 4 for easing any unwanted stress. When the stem 3 reaches its lowest position, shown in FIG. 4, the rubber spring 4 under the stem 3 becomes under a maximum pressure so that its pressing projection 4*d* directly acts on the switch region 7*a* of the membrane sheet 7 for switching on. When the key cap 1 is released, the resiliency of the rubber spring 4 presses up the stem 3 and thus, the stabilizer assembly 2 expands to its original position. As a the result, the key cap 1 returns to the off position, as shown in FIG. 2.

Figure 6:
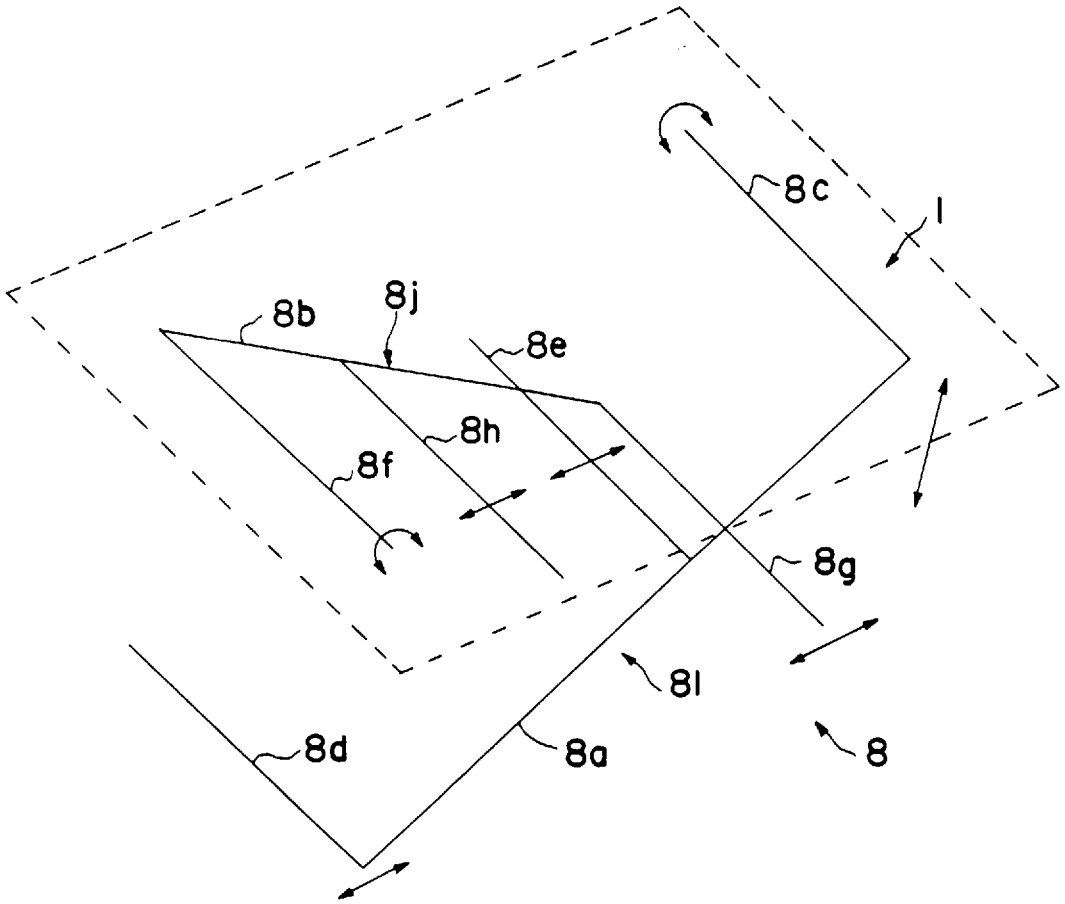
FIG. 6 is a schematic perspective view of another arrangement of the stabilizer assembly.

FIG. 6 is a schematic perspective view showing another embodiment of the present invention in which the stabilizer assembly 2 is replaced with a different type denoted by 8. The stabilizer assembly 8 comprises two arms 8*a* and 8*b*. The arm 8*a* has a pivot axle 8*c* extending horizontally from the upper end thereof. The pivot axle 8*c* has a length equal to that of the previous or first embodiment to match the width of the key cap 1 and is supported by the supports 1*a* of the key cap 1 for pivotal movement. Also, the arm 8*a* has a pivot axle 8*d* extending from the lower end thereof which is almost identical in the length and direction to the pivot axle 8*c*. The arm 8*a* has an actuator rod 8*e* extending from an intermediate thereof in the same direction as of the pivot axle 8*c*. Unlike as shown in FIG. 1, the lower pivot axle 8*d* is accommodated in a support slit 5*d* provided in the outer side of the wall 5*a* of the keyboard frame guide 5 for pivotal movement.

Similarly, the arm 8*b* has a pivot axle 8*f* extending horizontally from the upper end thereof. The pivot axle 8*f* has a length equal to that of the stabilizer assembly 2 to match the width of the key cap 1 and is supported by the supports 1*a* of the key cap 1 for pivotal movement. The arm 8*b* has a pivot axle 8*g* extending from the lower end thereof which is almost identical in the length and direction to the pivot axle 8*f*. The arm 8*b* has an actuator rod 8*h* extending from an intermediate thereof in the same direction as of the pivot axle 8*f*. Unlike as shown in FIG. 1, the lower pivot axle 8*g* is accommodated in a support slit 5*c* provided in the outer side of the wall 5*a* of the keyboard frame guide 5 for pivotal movement. A combination of the arm 8*a*, two pivot axles 8*c* and 8*d*, and actuator rod 8*e* constitutes an actuator frame 8*i* which thus has an E shape. Equally, a combination of the arm 8*b*, two pivot axles 8*f* and 8*g*, and actuator rod 8*h* constitutes an actuator frame 8*j* which has an E shape. The two actuator frames 8*i* and 8*j* are intersected to each other forming an X construction when viewed from the axial direction. As understood, the stabilizer assembly 8 is simpler in the structure than the stabilizer assembly 2 of the first embodiment but still offers the same effect. While the support slits 5*c* and 5*d* of the first embodiment are arranged separately of the keyboard frame guide 5, they are formed integral with the same in the second embodiment. However, the supports slits 5*c* and 5*d* of the second embodiment may be utilized in the first embodiment when the pivot axles 2*g*, 2*r*, 2*h*, and 2*i* of the stabilizer assembly 2 are modified to extend inwardly. Such a modification will be advantageous in producing a single component type of the pushbutton switch.

It would be understood that the present invention is not limited to the above described embodiments. For example, an array of the pushbutton switches of any embodiment may be disposed in a unit on a substrate thus forming a keyboard. The pushbutton switches of the embodiment may be installed in their respective casings for defining a pushbutton unit. Although the opening 3*a* of the stem 3 shown in FIGS. 1, 3, and 4 is flat at the bottom, an aperture 3*e* may be provided in the bottom deck of the stem 3 to lessen the pressing force exerted on the rubber spring 4. Aperture 3*e* is illustrated in FIG. 5 . This arrangement will allow the pressing projection 4*d* of the rubber spring 4 to not give an excessive stress to the membrane switch 7*a* when being urged downwardly by the stem 3 and prevent it from being ruptured. Also, the resilient movement of the rubber spring 4 will be eased thus increasing the operation life of itself as well as of the membrane sheet 7.

It is thus apparent to those skilled in the art that various changes and modifications will be possible without departing from the scope of the present invention.

As set forth above, the pushbutton switch of the present invention comprises: a membrane sheet carrying the circuit contacts; a keyboard frame guide disposed on a substrate; a stem having an opening therein where an external actuating force is applied to move the stem along the keyboard frame guide; a rubber spring disposed between the stem and the membrane sheet for making the circuit when being pressed down by the stem and lifting up the stem to its original position when the stem is released from a pressure; and a stabilizer assembly mounted at one end to the substrate for pivotal movement and formed of an X shape in cross section by intersecting at least two arms at center to each other, each arm having an actuator rod mounted to an central region thereof and accommodated in the opening of the stem for sliding movement; and a key cap supporting at back the upper ends of the arms of the stabilizer assembly for pivotal movement. When the key cap is pressed down, it moves straight down with its body kept in horizontal as being controlled by the stabilizer assembly. Accordingly, the stem is lifted down vertically and presses the rubber spring straight down to bottom. As the downward movement of the key cap is controlled by the stabilizer assembly, it will hardly be affected by a clearance between the stem and the keyboard guide. The pushbutton switch is also increased in physical strength. The stem has an aperture for easing a stress exerted on the rubber spring, whereby the return movement of the rubber spring will be encouraged and thus, the life of the membrane sheet will increase.

What is claimed is:

1. A pushbutton switch comprising:

a keyboard frame guide integral with a substrate and surrounding a circuit contact;

a stem having an opening and moving along the keyboard frame guide;

an elastic member disposed between the stem and the circuit contact;

a stabilizer assembly having two intersecting actuator frames forming an X shape in cross section, each actuator frame being arranged of an E shape by extending three parallel arms from an elongated arm of a supporting member, respectively; and a key cap supporting the upper ends of the frames of the stabilizer assembly for pivotal movement.

2. A pushbutton switch according to claim 1, wherein the stabilizer assembly is supported for pivotal movement by support slits which are integral with the keyboard frame guide.

3. A keyboard pushbutton switch comprising:

a membrane switch;

a keyboard frame guide disposed about said membrane switch;

a stem having an opening and disposed within the keyboard frame guide;

a spring disposed between the stem and the membrane switch; and two actuator frames intersecting to form an X shape in cross section, each actuator frame having an E shape by extending three parallel arms from a supporting member;

wherein the middle parallel arm of each actuator frame is received within the opening of the stem.

4. A pushbutton switch for opening and closing a contact circuit, comprising:

a keyboard frame guide integral with a substrate and disposed about a contact circuit;

a stem having an opening and movable along the keyboard frame guide;

a rubber spring disposed between the stem and the contact circuit, said spring making contact with the contact circuit when pressed down by the stem;

a stabilizer assembly mounted at one end to the substrate for pivotal movement, having two intersecting members forming an X shape in cross section, wherein each member is formed into an E shape by extending three parallel arms such the middle parallel arm is received within the stem opening; and a key cap supporting the upper ends of the members of the stabilizer assembly for pivotal movement.

5. A switch comprising:

a movable key cap;

a stem having an opening;

two members intersecting to form an X shape, each member being formed into an E shape by extending three parallel arms such that the middle parallel arm is received within the opening of the stem, wherein the two members collapse to move the stem downward in response to downward movement of the key cap; and a rubber spring disposed between the stem and a contact circuit, wherein the rubber spring contacts the contact circuit in response to downward movement of the stem.

6. A switch comprising:

a key cap;

a contact circuit;

a stem having an opening;

a spring disposed between the contact circuit and the stem;

a frame disposed about the contact circuit and receiving the stem; and a stabilizer pivotally mounted with respect to the frame, said stabilizer formed into an E shape by extending three parallel arms with the middle arm received within the stem opening, the stabilizer moving the stem downward in response to downward movement of the key cap;

wherein the contact circuit is contacted by the spring in response to downward movement of the stem.

7. A switch comprising:

a stem actuating a contact circuit and having an opening;

a stem stabilizer formed into an E shape by extending three parallel arms with the middle arm received within said opening; and a key cap contacting the stem stabilizer;

whereby the contact circuit is actuated in response to downward movement of the key cap.

* * * * *